US010900622B1

(12) United States Patent
D'Ascanio et al.

(10) Patent No.: US 10,900,622 B1
(45) Date of Patent: Jan. 26, 2021

(54) VERSATILE LIGHTING FIXTURE

(71) Applicants: Franco D'Ascanio, Key Colony Beach, FL (US); Sean Snowden, Marathon, FL (US); Harold Zimmermann, Riverton, NJ (US)

(72) Inventors: Franco D'Ascanio, Key Colony Beach, FL (US); Sean Snowden, Marathon, FL (US); Harold Zimmermann, Riverton, NJ (US)

(73) Assignee: COASTAL SOURCE, LLC, Marathon, FL (US)

( * ) Notice: Subject to any disclaimer, the term of this patent is extended or adjusted under 35 U.S.C. 154(b) by 0 days.

(21) Appl. No.: 17/012,753

(22) Filed: Sep. 4, 2020

Related U.S. Application Data

(60) Provisional application No. 62/898,329, filed on Sep. 10, 2019.

(51) Int. Cl.

| | |
|---|---|
| ***F21S 8/02*** | (2006.01) |
| ***F21V 33/00*** | (2006.01) |
| ***F21V 31/00*** | (2006.01) |
| ***F21S 8/08*** | (2006.01) |
| ***F21W 131/10*** | (2006.01) |
| ***F21K 9/237*** | (2016.01) |

(52) U.S. Cl.
CPC ..... *F21S 8/022* (2013.01); *F21K 9/237* (2016.08); *F21S 8/081* (2013.01); *F21V 31/00* (2013.01); *F21V 33/006* (2013.01); *F21V 33/0056* (2013.01); *F21W 2131/10* (2013.01)

(58) Field of Classification Search
CPC .... F21S 8/022; F21S 8/08; F21S 8/081; F21S 8/083; F21V 14/02; F21V 33/0056; F21W 2131/10; F21W 2131/107; F21W 2131/109
See application file for complete search history.

(56) References Cited

U.S. PATENT DOCUMENTS

| | | | | |
|---|---|---|---|---|
| 5,183,330 A * | 2/1993 | Rishel | B60Q 1/0483 | 362/295 |
| 7,905,621 B1 * | 3/2011 | Hickman | F21S 8/022 | 362/153.1 |
| 9,004,706 B1 * | 4/2015 | Banfield | F21V 33/0056 | 362/86 |
| 2005/0024857 A1 * | 2/2005 | Vishwamitra | A63J 17/00 | 362/152 |
| 2006/0002136 A1 * | 1/2006 | Buelow, II | F21V 21/30 | 362/581 |

(Continued)

*Primary Examiner* — Alexander K Garlen
(74) *Attorney, Agent, or Firm* — Stuart M. Goldstein

(57) ABSTRACT

A versatile lighting fixture has an elongated, vertical channel member with back and opposing side walls forming a vertical passageway. A baffle member is located within passageway and extends the length of the channel member. The baffle member has an upper support member which is fixedly attached to a gimbal LED module located within the channel member. The module has wiring which extends through the passageway. A lighting fixture mount is located at the bottom of the channel. The gimbal LED module has a top trim plate member with an opening and a series of drainage grooves extending downward from the opening. When the LED lamp faces upward in the lighting fixture, water accumulating on and around the trim plate member is drained away from the module through the drainage grooves.

10 Claims, 5 Drawing Sheets

(56) References Cited

U.S. PATENT DOCUMENTS

| | | | | |
|---|---|---|---|---|
| 2006/0262542 | A1* | 11/2006 | Ibbitson | F21S 8/022<br>362/368 |
| 2010/0061097 | A1* | 3/2010 | Krogman | F21V 21/30<br>362/249.03 |
| 2016/0323978 | A1* | 11/2016 | Raza | H05B 45/46 |
| 2017/0002984 | A1* | 1/2017 | Beausoleil | F21V 11/00 |
| 2017/0311062 | A1* | 10/2017 | Garrett | H05B 45/00 |

* cited by examiner 1a
28
30

1
22
12
2
26
24
20

1
26
24
22

1
22
17
4
18
2
4

2
6
4
10
8
20
18
22
14
17
12
16

22
13
15
26
3
7

5
25
W
W
3

22
26
22
22
3

5
9
11
13
3
25
7

22
3
13
26
24

25°
25°
22

VERSATILE LIGHTING FIXTURE

RELATED APPLICATION

The application claims the benefit of provisional application 62/898,329, filed on Sep. 10, 2019.

FIELD OF THE INVENTION

The present invention relates to contemporary styled high-performance lighting fixtures having unique design features and drainage capabilities.

BACKGROUND OF THE INVENTION

While there are many lighting fixtures having various designs and illumination features, very few offer the versatility of reconfiguration, while combining high quality downlighting, uplighting, path lighting, and angled lighting. Most contemporary fixtures are generally made of extruded or case tubes, which limit access to the interior and the fixed position of the LED's adjustability, functionality, and performance.

In addition, although articulating gimbal (eyeball) lighting fixtures have been used for a long period of time in typical ceiling, i.e. downward facing, applications, they have not been applied to outdoor environments in upward facing applications, since they can hold pockets of water when articulated. This results in two major problems. First, water ingress as the fixture's lamp heats up when on and then cools when turned off, creates a vacuum that can draw water into the delicate internal electronic components and circuitry of the lamp. This results in permanent damage and failure. Second, when the fixture is articulated, standing water results which causes the accumulation of algae and the collection of dirt/debris. This diminishes light performance, beam spread and focus.

SUMMARY OF THE INVENTION

It is thus the object of the present invention to provide contemporary styled, high performance, versatile lighting fixtures which overcome the disadvantages and limitations of prior lighting fixtures.

These and other objects are accomplished by the present invention, a versatile lighting fixture which has an elongated, vertical channel member with back and opposing side walls forming a vertical passageway. A baffle member is located within passageway and extends the length of the channel member. The baffle member has an upper support member which is fixedly attached to a gimbal LED module located within the channel member. The module has wiring which extends through the passageway. A lighting fixture mount is located at the bottom of the channel. The gimbal LED module has a top trim plate member with an opening and a series of drainage grooves extending downward from the opening. When the LED lamp faces upward in the lighting fixture, water accumulating on and around the trim plate member is drained away from the module through the drainage grooves.

The novel features which are considered as characteristic of the invention are set forth in particular in the appended claims. The invention, itself, however, both as to its design, construction and use, together with additional features and advantages thereof, are best understood upon review of the following detailed description with reference to the accompanying drawings.

DETAILED DESCRIPTION OF THE INVENTION

Figure 13:
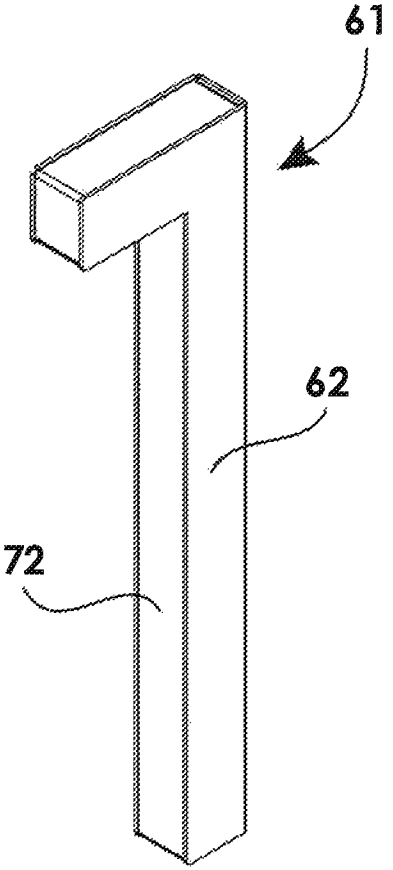
FIG. 13 is a perspective view of a third configuration of the lighting fixture of the present invention.
Figure 7:
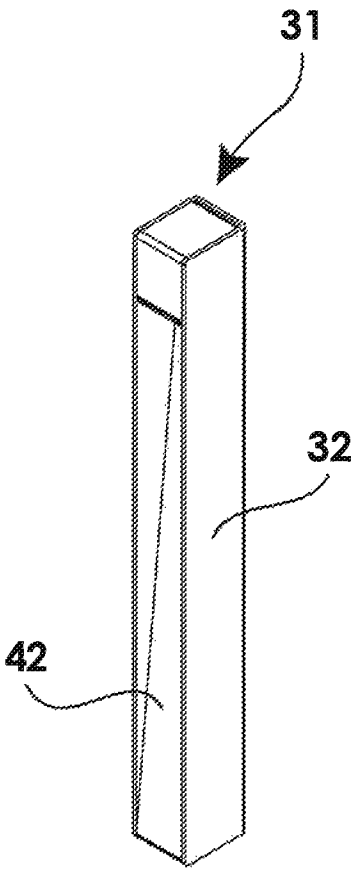
FIG. 7 is a perspective view of a second configuration of the lighting fixture of the present invention.
Figure 1:
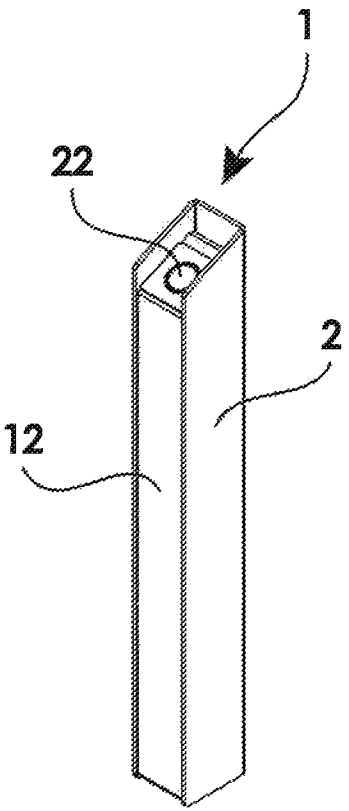
FIG. 1 is a perspective view of a configuration of the lighting fixture of the present invention.

Lighting fixture 1, shown in FIGS. 1-6, comprises elongated, vertical channel member 2 having back wall 4 and side walls 6 and 8 forming vertical passageway 10 which extends the length of the channel member. Baffle member 12 is located within passageway 10 of channel member 2 (see FIGS. 1, 4 and 5) and it too extends the length of the channel member.

Baffle member 12 comprises top section 14, bottom section 16, and wall section 17. Upper support member 18 is located at top section 14 and lighting fixture mount 20 is located at bottom section 16. Gimbal LED module 22 is fixedly attached to upper support member 18. Module 22 has electrical plug 24 connected to electrical wiring 26 which extends through passageway 10. Upper support member 18 is angled upward such that module 22 is positioned within the upper support member to provide uplighting.

Figures 2, 3, 4, 5, 6:
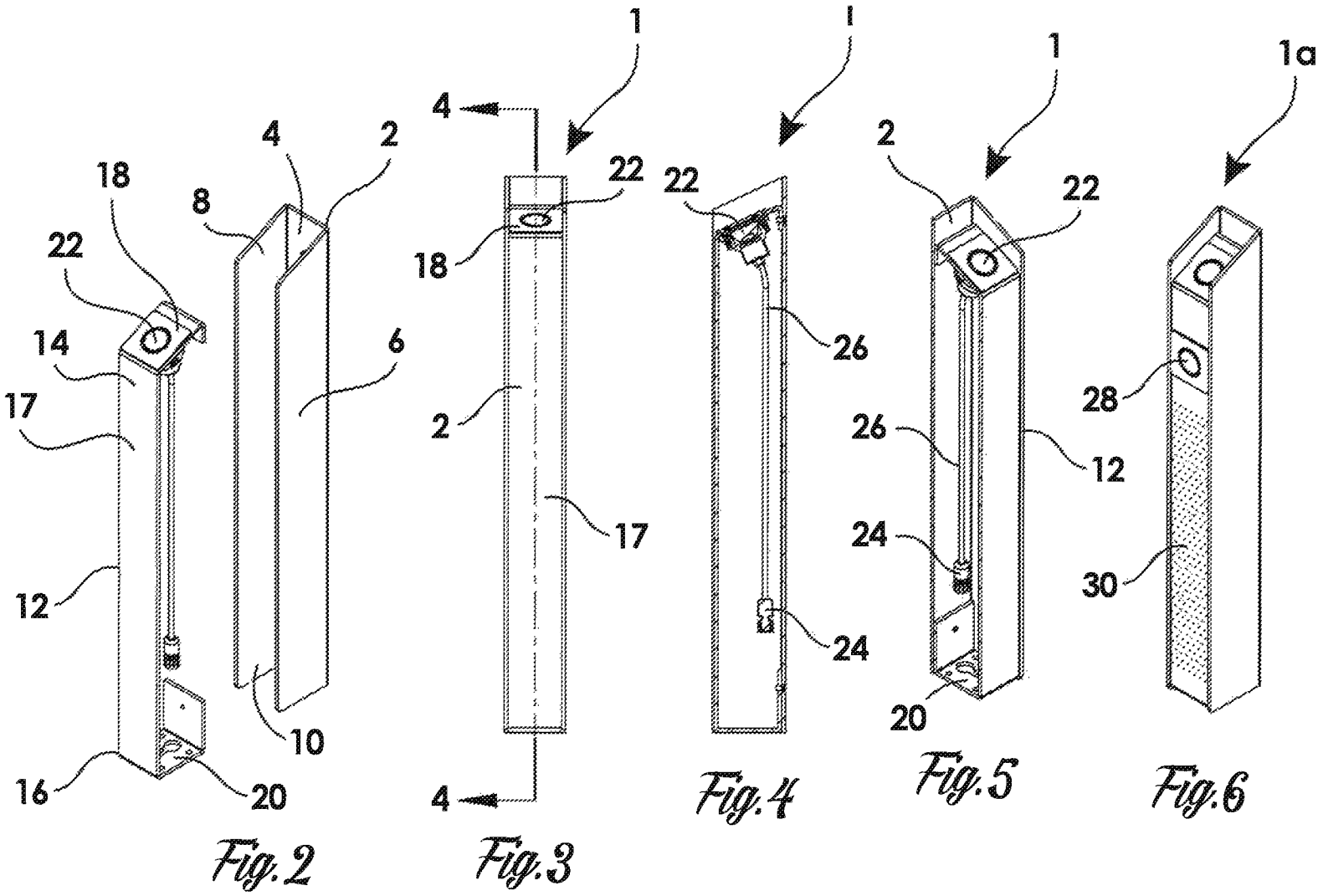
FIG. 2 is an exploded view of the lighting fixture shown in FIG. 1.
FIG. 3 is a front view of the lighting fixture shown in FIG. 1.
FIG. 4 is a cross-sectional view taken from FIG. 3.
FIG. 5 is a perspective view of the lighting fixture shown in FIG. 1, with one side wall removed for clarity.
FIG. 6 is a perspective view of the lighting fixture shown in FIG. 1, disclosing additional features of the fixture.

FIG. 6 shows lighting fixture similar to fixture 1, with added features, including lateral gimbal LED module 28 located within the passageway of fixture 1*a*, positioned to provide ground path lighting, and integrated speakers 30, also housed within the fixture's passageway.

Lighting fixture 31, shown in FIGS. 7-12, comprises elongated vertical channel member 32 having back wall 34 and side walls 36 and 38 forming vertical passageway 40 which extends the length of the channel member. Baffle member 42 is positioned at an angle within passageway 40 of channel member 32, extending from bottom section 33 to top section 35 of the channel member (see FIGS. 7, 10 and 11).

Baffle member 42 comprises top section 44, angled wall section 4, and bottom section 46. Upper support member 48 is located at top section 44 and lighting fixture mount 50 is located at bottom section 46. Upper support member 48 comprises upper platform 49 and lower support platform 51.

Gimbal LED module 52 is fixedly attached to lower support platform 51 of upper support member 48. Module 52 has electronic plug 54 connected to electrical wiring 56 which extends through passageway 40. Lower support platform 51 of upper support member 48 is angled such that module 52 is positioned within the upper support member to provide downwardly angled lighting.

Figures 8, 9, 10, 11, 12:
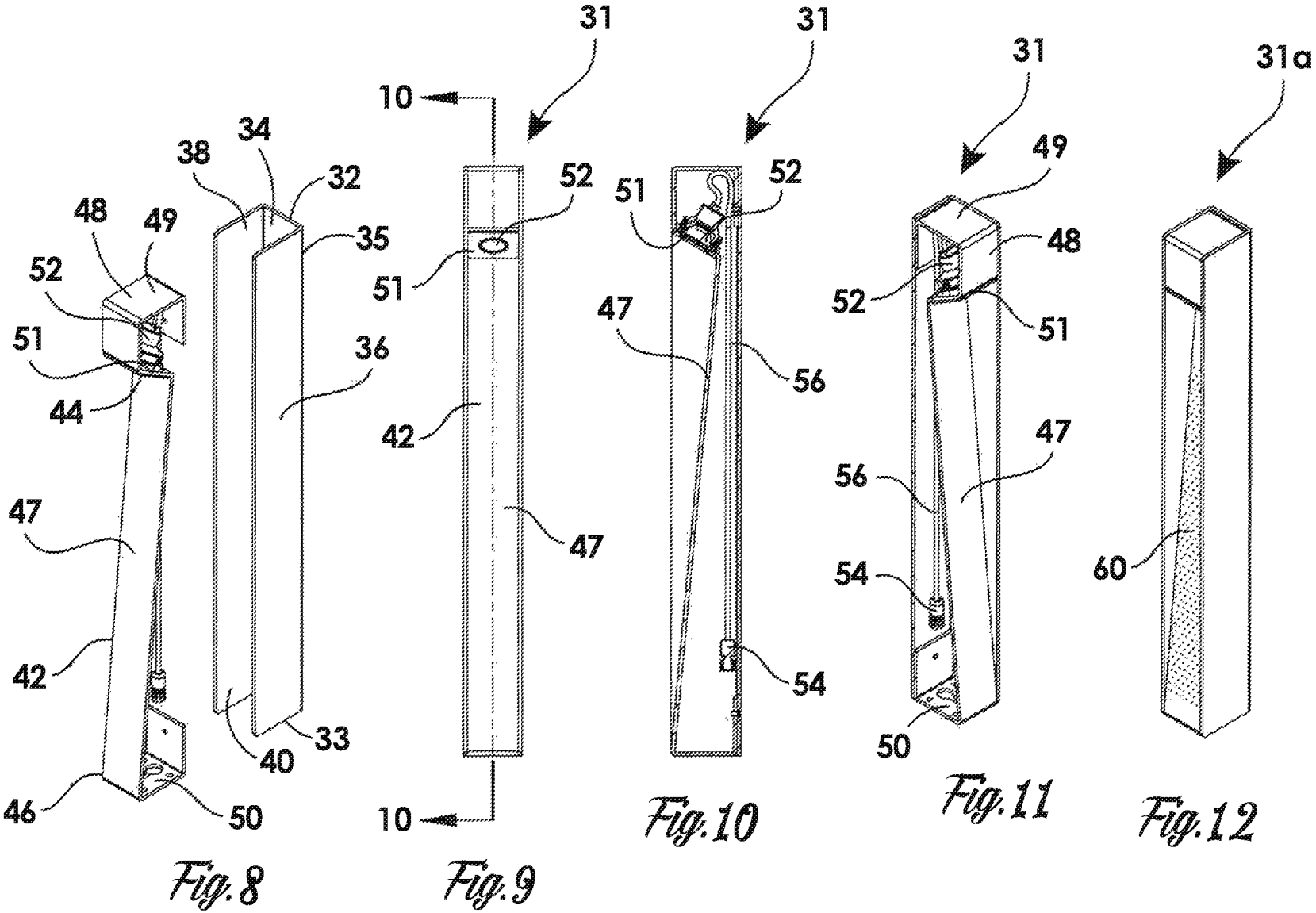
FIG. 8 is an exploded view of the lighting fixture of the present invention shown in FIG. 7.
FIG. 9 is a front view of the lighting fixture of the present invention shown in FIG. 7.
FIG. 10 is a cross-sectional view taken from FIG. 9.
FIG. 11 is a perspective view of the lighting fixture shown in FIG. 7, with one of its side walls removed for clarity.
FIG. 12 is a perspective view of the lighting fixture shown in FIG. 7, disclosing an additional feature of the fixture.

FIG. 12 shows lighting fixture 31*a* similar to fixture 31, with added features, including integrated speakers 60, also housed within the passageway of fixture 31*a*.

Lighting fixture 61, shown in FIGS. 13-17, comprises elongated vertical channel member 62 having back wall 64 and side walls 66 and 68 forming vertical passageway 70 which extends the length of the channel member. Top elements 67 and 69 extend outwardly from channel member 62 forming opening 71 therebetween. Baffle member 72 is located within passageway 70 of channel member 62 (see FIGS. 13, 16 and 17) and it too extends the length of the channel member.

Baffle member 72 comprises top section 74, vertical wall section 75, and bottom section 76. Upper support member 78 is located at top section 74 and lighting fixture mount 80 is located at bottom section 76. Upper support member 78 comprises upper platform 79 and lower support platform 81.

Gimbal LED module 82 is fixedly attached to lower support platform 81 of upper support member 78. Module 82 has electric plug 84 connected to electrical wiring 86 which extends through passageway 70. Lower support platform 81 is substantially perpendicular to vertical wall section 75 such that module 82 is positioned with upper support member 78 to provide direct, downward lighting.

Figures 14, 15, 16, 17, 18:
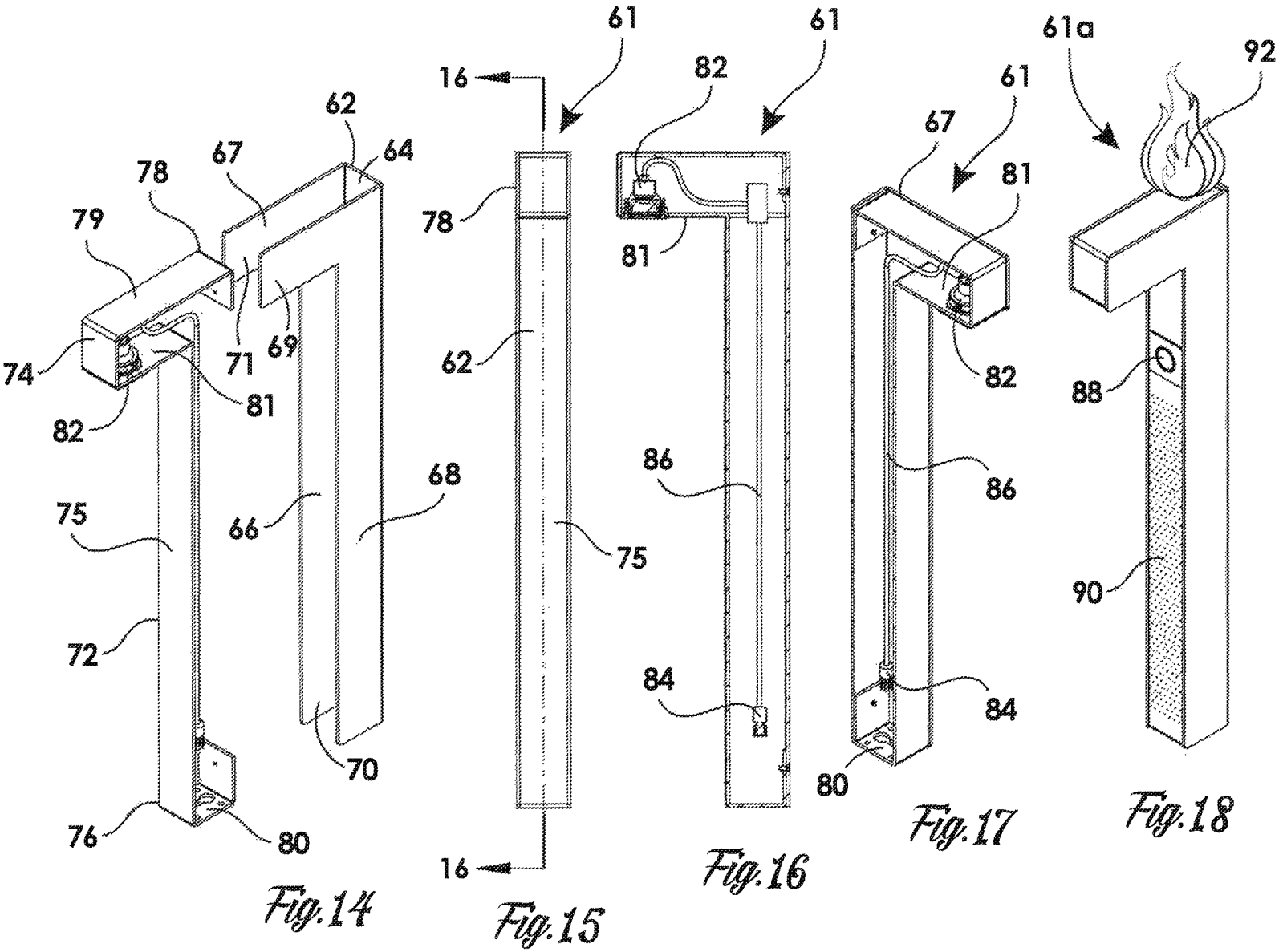
FIG. 14 is an exploded view of the lighting fixture of the present invention shown in FIG. 13.
FIG. 15 is a front view of the lighting fixture of the present invention shown in FIG. 13.
FIG. 16 is a cross-sectional view taken from FIG. 15.
FIG. 17 is a perspective view of the lighting fixture of the present invention shown in FIG. 13, with a side wall removed for clarity.
FIG. 18 is a perspective view of the lighting fixture shown in FIG. 13, disclosing additional features of the fixture.

FIG. 18 shows lighting fixture 61*a* similar to fixture 61, with added features, including lateral gimbal LED module 88 located within the passageway of fixture 61*a*, positioned to provide ground path lighting, integrated speakers 90, and optional Tiki oil flame lamp 92.

Gimbal LED module identified as 22, 52, and 82 in the FIGs. and 22 in FIGS. 19-24, is a self-contained, articulating lighting system comprising top trim plate member 3, trim plate member opening 5, friction gasket 7, gimbal LED lamp 9, mounting ring 11, locking ring 13, optical glass lens 13, replaceable lenses 15, electrical wiring 26 and electrical plug 24.

Integrated drainage grooves 25 extending downwardly from the top of opening 5 within trim place member 3, succeed in channeling away accumulating water W from module 22 and hence the lighting fixture. This allows the LED lamp to face upward in wet locations without lighting interference.

Figures 19, 20, 21, 22, 23, 24:
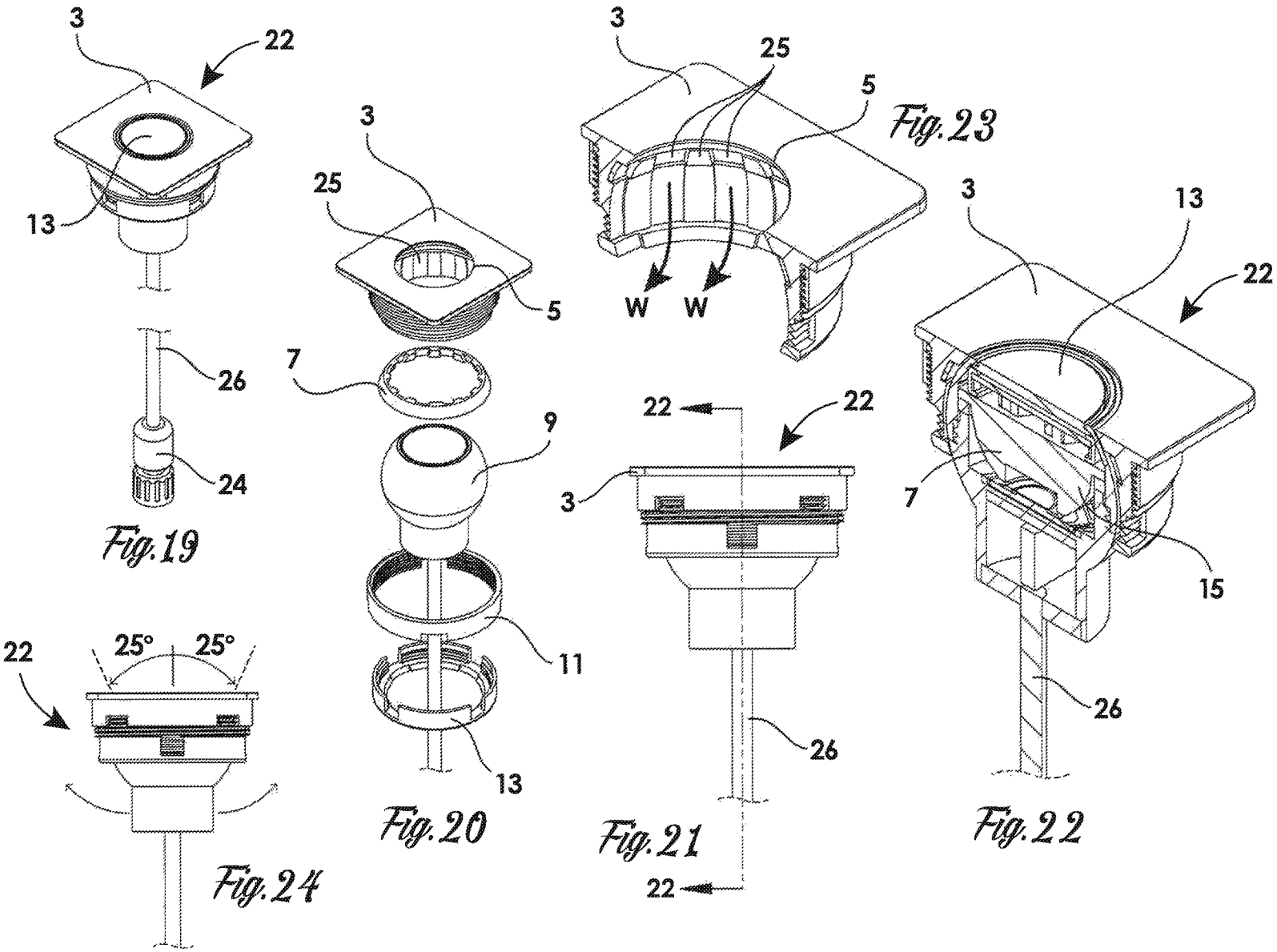
FIG. 19 is a perspective view of the gimbal LED module of the present invention.
FIG. 20 is an exploded view of the components of the gimbal LED module of the present invention.
FIG. 21 is an elevation view of the gimbal LED module of the present invention.
FIG. 22 is a cross-sectional view taken from FIG. 21.
FIG. 23 is a partial sectional view of the trim plate member of the gimbal LED module of the present invention.
FIG. 24 is an elevation view of the gimbal LED module of the present invention exhibiting its range of articulation.

Self-contained environmentally sealed module 22 is mounted within its lighting fixtures, becoming an exoskeleton, requiring no waterproof protection, no wiring, and no moving parts to aim the direction of the LED beam. In addition, as shown in FIG. 24, module 22 is capable of 25 degrees of articulation in any direction. Module 22 is rated up to IP-68, with all internal components thermal epoxy embedded.

As well as being utilized in fixtures 1, 31, and 61 as described herein, the module gimbal LED module can be used in a variety of applications, including, but not limited to, uplighting, path lighting, downlighting, hanging lighting, step lighting, marker lighting, wash lighting, well lighting, tree lighting, and soffit lighting.

The C-shell construction of the channel and baffle members are fabricated of durable, corrosion resistant anodized aluminum, allowing for the ready integration of additional features e.g. LED downlighting for the creation of decorative shadows on the ground, a second LED for ground washing, integrated speakers, and the Tiki oil flame. The fixtures themselves have no moving parts.

It is contemplated that the fixtures of the present invention can be used for the following applications:

L path lighting
L path lighting with internal downlighting
L path lighting with ground plane lighting
L path lighting with integrated speaker
Bollard path lighting
Bollard path lighting with integrated down light
Bollard path lighting with ground plane light
Bollard path lighting with integrated speaker
Bollard path lighting with Tiki torch
Uplighting
Uplighting with integrated downlight
Uplighting with ground plane light
Uplighting with integrated speaker
Bollard internal downlighting
Bollard speaker
Bollard Tiki torch Certain novel features and components of this invention are disclosed in detail in order to make the invention clear in at least one form thereof. However, it is to be clearly understood that the invention as disclosed is not necessarily limited to the exact form and details as disclosed, since it is apparent that various modifications and changes may be made without departing from the spirit of the invention.

The invention claimed is:

1. A lighting fixture comprising:

an elongated, vertical channel member having a back wall and opposing side walls, the walls forming a vertical passageway extending the length of the channel member, a baffle member located within the passageway of the channel member extending the length of the channel member, said baffle member comprising:

a top section and a bottom section;

an upper support member located at the top section, said support member being fixedly attached to a gimbal LED module located within the channel member, the LED module having electrical wiring which extends through the passageway and which has an electric plug at its distal end; and a lighting fixture mount located at the bottom section;

wherein the gimbal LED module comprises:

a too trim olate member having a top surface, said trim plate member having an opening through the top surface and a series of drainage grooves extending downwardly from the opening; and an LED lamp fixedly attached to the trim plate member, said trim plate member circumscribing and housing an LED lamp, the electrical wiring extending from the LED lamp through the passageway:

wherein when the LED lamp faces upward in the fixture, any water accumulating on and around the trim plate member is drained away from the module through the drainage grooves.

2. The lighting fixture as in claim 1 wherein a lateral gimbal LED module is located in the passageway, said lateral gimbal LED module being positioned to provide ground plane lighting.

3. The lighting fixture as in claim 1 wherein integrated speakers are located within the passageway.

4. The lighting fixture as in claim 3 wherein a lateral gimbal LED module is located in the passageway, said lateral gimbal LED module being positioned to provide ground plane lighting.

5. The lighting fixture as in claim 1 wherein the upper support member is angled upward and wherein the gimbal LED module is positioned within the upper support member to provide uplighting.

6. The lighting fixture as in claim 1 wherein the channel number has two top elements extending outwardly from the channel member, the top elements forming an opening therebetween, the upper support member extending within the opening.

7. The lighting fixture as in claim 6 wherein the gimbal LED module is positioned within the upper support member to provide downlighting.

8. The lighting support fixture as in claim 1 wherein the baffle member is positioned at an angle within the passageway of the channel member.

9. The lighting support fixture as in claim 1 wherein the gimbal LED module is positioned within the upper support member to provide downwardly angled lighting.

10. The lighting support fixture as in claim 1 further comprising a mounting ring and a locking ring for fixedly attaching the gimbal LED module to the trim plate member.

* * * * *